US012196428B2

(12) United States Patent
Davison

(10) Patent No.: US 12,196,428 B2
(45) Date of Patent: Jan. 14, 2025

(54) HEATING APPARATUS

(71) Applicant: Focal Point Fires PLC, Christchurch (GB)

(72) Inventor: Peter James Davison, Christchurch (GB)

(73) Assignee: FOCAL POINT FIRES PLC, Christchurch (GB)

( * ) Notice: Subject to any disclaimer, the term of this patent is extended or adjusted under 35 U.S.C. 154(b) by 0 days.

(21) Appl. No.: 18/361,032

(22) Filed: Jul. 28, 2023

(65) Prior Publication Data

US 2024/0200784 A1 Jun. 20, 2024

Related U.S. Application Data

(63) Continuation of application No. 16/710,568, filed on Dec. 11, 2019, now abandoned.

(30) Foreign Application Priority Data

Dec. 12, 2018 (GB) ..... 1820239

(51) Int. Cl.
*F24C 7/00* (2006.01)

(52) U.S. Cl.
CPC ..... *F24C 7/004* (2013.01)

(58) Field of Classification Search
CPC ..... H05B 3/008; F24B 1/185; F24B 1/1808; F21W 2131/307; F24D 19/1096; F21S 10/043; F21S 10/046; F21S 10/04; F24C 7/004; F24C 3/006
See application file for complete search history.

(56) References Cited

U.S. PATENT DOCUMENTS 2,984,032 A * 5/1961 Cornell ..... F24C 7/004 40/428
3,157,776 A * 11/1964 Sohn ..... F24H 3/0411 219/532
3,265,859 A * 8/1966 Castello ..... F24H 3/0405 392/350
4,197,447 A * 4/1980 Jones ..... H05B 3/008 126/110 R
4,900,898 A * 2/1990 Kling ..... H05B 3/008 392/503

(Continued)

FOREIGN PATENT DOCUMENTS

EP 1020685 A2 7/2000
GB 2302730 A 1/1997

(Continued)

OTHER PUBLICATIONS

European Patent Application No. 19215407.8, Extended European Search Report dated Apr. 15, 2020, 8 pages.

(Continued)

*Primary Examiner* — David R Dunn
*Assistant Examiner* — Christopher E Veraa
(74) *Attorney, Agent, or Firm* — Fredrikson & Byron, P.A.

(57) ABSTRACT

An electric heating apparatus (1) including an electric heater (12) and a flame simulator (2). The apparatus includes an air outlet channel (14) for expelling heated air wherein the cross-sectional area of the air outlet channel (13) increases with increased distance from the heater.

13 Claims, 3 Drawing Sheets

(56) References Cited

U.S. PATENT DOCUMENTS

| | | | | |
|---|---|---|---|---|
| 6,053,165 | A * | 4/2000 | Butler | F24C 7/004 40/428 |
| 6,393,207 | B1 * | 5/2002 | Martin | F24C 7/004 40/431 |
| 7,194,830 | B2 * | 3/2007 | Hess | F24C 7/004 40/428 |
| 2004/0060213 | A1 * | 4/2004 | Schroeter | F21S 10/04 40/428 |
| 2016/0195277 | A1 * | 7/2016 | Li | F24B 1/1808 392/348 |
| 2017/0363320 | A1 * | 12/2017 | Crowe | F24H 3/062 |

FOREIGN PATENT DOCUMENTS

| | | | |
|---|---|---|---|
| GB | 2376292 | B | 8/2003 |
| GB | 2395550 | A | 5/2004 |
| GB | 2421568 | A | 6/2006 |
| GB | 2428784 | A | 2/2007 |

OTHER PUBLICATIONS

GB Patent Application No. 1820239.0, Search Report under Section 17(5) dated Jun. 20, 2019, 3 pages.

* cited by examiner

HEATING APPARATUS

RELATED APPLICATIONS

This application is a continuation of U.S. patent application Ser. No. 16/710,568, filed Dec. 11, 2019, which claims priority to British Application No. 1820239.0, filed Dec. 12, 2018, the contents of which are incorporated herein by reference.

The present invention relates to heating apparatus, and in particular, embodiments including a flame simulator for creating the appearance of a burning fire produced by solid fuel. Such heating apparatus may be used to heat a room while also giving the impression of a real solid fuel fire.

Wood-burning, gas-powered and electric fireplaces are three popular types of fireplaces that are available to consumers. Wood-burning fireplaces provide good heat production and efficiency, as well as creating a cosy and pleasant environment. Gas-powered fireplaces also offer good heat production but do not produce the desirable flame flickering and wood crackling sound associated with a wood-burning fireplace. However, both of these types of fireplaces exhibit disadvantages. Wood-burning fireplaces require more effort for operation and manipulating logs and cleaning the ashes can be messy. Gas-powered fireplaces are convenient, but carry associated risks of explosion or gas leaks into the home. Both of these fireplaces demand appropriate installation, insulation and ventilation to avoid risks of accidents occurring at the premises. In addition, studies have proven that wood smoke can be dangerous to the health, due to carbon monoxide poisoning and to human lung and respiratory systems not being able to adequately filter particles emitted by wood combustion.

Electric heaters with associated flame simulation apparatus mimicking solid fuel fires are known and becoming increasing popular. Such heaters offer safety as well as easy maintenance and installation. Electric heaters also are generally a cheaper option compared to wood-burning or gas-powered fireplaces. Fuel-powered (whether gas, wood or other solid fuel) fireplaces typically also require chimneys or flues for the combustion gases to exit the residence. Currently, liquid-crystal display (LCD) flame simulation technology is employed with a wide range of electric heaters to provide a visual simulation of a solid fuel fire to accompany the heat produced by the electric heater. Heaters including light-emitting diode (LED) flame simulation apparatus are another known option as these are capable of simulating flames that resemble the flames of wood-burning fireplaces. LED simulators use low energy LEDs and heaters may also be more pleasing to the eye when used in conjunction with a simulated glowing fuel bed.

Some known electric heaters including simulated flames are disclosed in, for example, GB2376292, U.S. Pat. Nos. 2,984,032 and 7,194,830.

Electric fireplaces have a heating element over which cooler inlet air is moved by a fan to heat that air which is then expelled as warmer air into the room. An adjacent or accompanying flame simulator is provided to simulate the appearance (and sometimes also sound) of fire, such as hot embers and flickering flames. Such arrangements will give the appearance of a real fire as well as producing heat.

In order for a heating apparatus including a flame simulator to be as close in appearance to a real fire as possible, it is desirable to have as little indication as possible that there is an electric heat source providing the heat or warm air. It is therefore necessary to conceal the heater element.

It is known to position the heating element behind a protective grille. The grille serves as a safety cover for the heating element while also serving as a heating outlet, through which the warm air warmed by an electric heating element would be expelled to heat the room. A glowing electric heating element may be visual through this grille. A heating element visual through the grille ruins the aura that there is a real fire and has an adverse aesthetic impact. Furthermore, grilles on current appliances may be large and unsightly.

Embodiments of the current invention provide an improved heat outlet for a heating element of electric fires.

The known grilles have a large visible area for heat to exit. This would result in other features of the electric fire being designed around the grille, such as the front panel of the flame simulation system being positioned slightly further back than the grille. The grille heating outlet of current systems is a negative point for designs. By adjusting the design of the grille outlet, the design can be made more visually pleasing. Making the heat outlet or grille of the vents less visible while remaining functional can provide a better appearance and experience for the consumer.

The air outlet and any associated grille must be sufficiently large for air heated by the heater element to move easily away from the heater element. A safety cut out on the heater element means that the air pressure should reduce as the heated air moves away from the heater element. This means that the air outlet and any associated grille must be sufficiently large for there to be no increase in pressure in the heating apparatus between the heater element and the air outlet. Known heating apparatus with flame simulation compartments achieve this by providing a relatively large broad or wide central air outlet with an associated grille element above the flame simulation compartment. The known grilles have significant size in both orthogonal directions (i.e. the horizontal and vertical dimensions when the fireplace is in situ or installed).

The necessary size and steps of the grille element provided at the front of the hating apparatus mean that it is highly visible.

Electric heaters require an air inlet to provide a flow of air to be heated by the heating element. For heating apparatus comprising a hidden electric heating element adjacent a flame simulator such as heating apparatus placed in a wall cavity or fireplace, air inlet holes must be provided. These can be unsightly and if provided in the wall itself may be expensive or awkward to make.

Embodiments of the invention provide an improved heating apparatus including means for simulating flames from a solid fuel fire.

The invention is defined in the appended independent claims, to which reference should be made. Preferred and/or alternative features are set out in the dependent claims.

Heating apparatus comprising: a housing having a flame simulation compartment and a viewing window for viewing said compartment and flames simulated therein; a flame simulator for simulating flames in said flame simulation compartment; a heater unit adjacent the flame simulation compartment, the heater unit including: a heater, an air inlet, an air inlet channel connecting the air inlet to the heater, an air outlet, an air outlet channel connecting the heater to the air outlet, and a fan for drawing air into the air inlet, to then flow through the air inlet channel past the heater, through the air outlet channel and expelling air through the air outlet, wherein the cross-sectional area of the air outlet channel in the planes perpendicular to the direction of the flow of air therethrough increases with increased distance from the heater.

Embodiments of the invention do not require supplemental and possibly unsightly air inlets which need drilling into a wall receiving the fireplace. Embodiments of the invention may also have an unobtrusive air outlet. As well as being aesthetically more pleasing, the provision of an unobtrusive air outlet which does not require a significant step back the front face of the flame simulation compartment makes for an aesthetically more pleasing fireplace. The increasing cross-sectional area of the air outlet channel means that it is possible to provide a relatively narrow unobtrusive air outlet without the heater stalling or over-heating.

Preferably the air outlet is significantly wider than it is high when the heating apparatus is installed.

Preferably the air outlet channel includes two side walls whose surface planes subtend an obtuse angle to each other.

Preferably the obtuse angle is between 120 degrees and 150 degrees.

Preferably the obtuse angle is between 130 degrees and 135 degrees.

Preferably the heater unit is an electric heater.

Preferably an air inlet is located above the air outlet and the air inlet channel is arranged above the air outlet channel.

Preferably the air inlet and air outlet are substantially horizontal slots.

Preferably the air inlet and/or outlet slots are, when the apparatus is installed, 12 mm or less in height: preferably 8 or 9 mm high.

Preferably the air inlet channel and air outlet channels each angle downwards as they approach the respective air inlet and air outlet. This may provide a curtain-like flow of heated air which makes for efficient and comfortable heating.

Preferably the air outlet channel is, when the apparatus is installed, wider than it is higher.

Preferably the width of the air outlet channel is more than 1½ times the height.

Preferably the width of the air outlet channel is approximately three times the height.

Preferably the heat outlet extends across more than 25% of the width of the front of the heating apparatus.

Preferably the heat outlet extends across more than 50% of the width of the front of the heating apparatus.

Preferably the heat outlet extends across more than 75% of the width of the front of the heating apparatus.

Embodiments of the present invention will now be described by way of non-limiting example with reference to the accompanying schematic drawings, in which.

As used herein the terms "top", "bottom", "side", "front" and "back" describe the orientation of the device as it would be when installed in a wall or wall cavity and ready for use, the term "width" is used to describe the distance between opposing sides of the device, the term "height" is used to describe the distance between the top and bottom of the device, and the term "depth" is used to describe the distance from the front to the back of the device.

Figure 1:
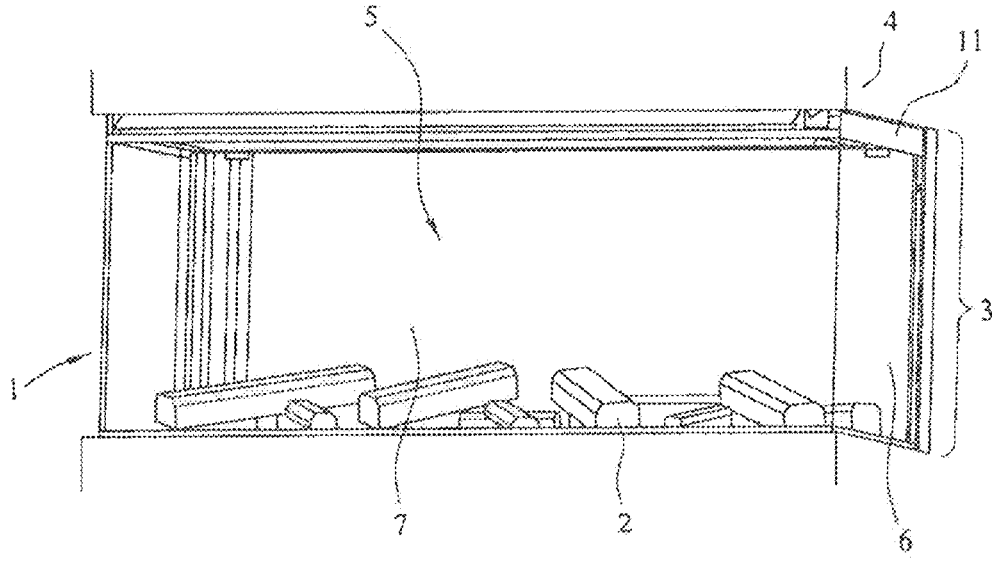
FIG. 1 is a front perspective view of a fireplace heater embodying the present invention, and installed in a wall.
Figure 2:
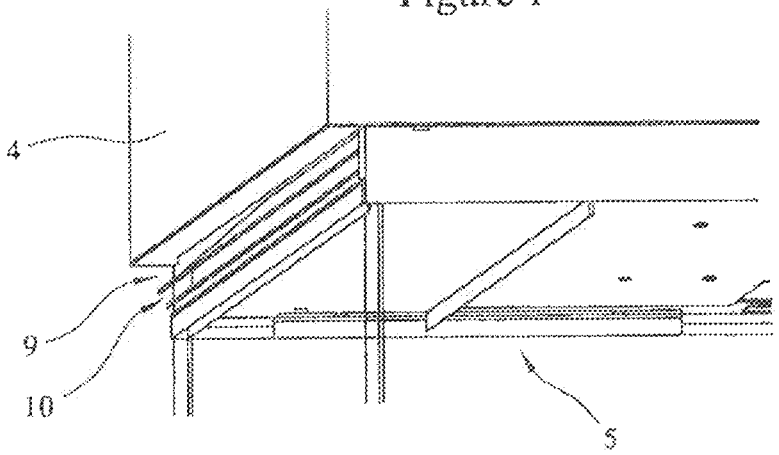
FIG. 2 is a side perspective view of the top portion of fireplace heater of FIG. 1.

Referring to FIGS. 1 & 2, the fireplace heater 1 including a flame simulator 2 is located in a cavity 3 in a wall 4. The heating apparatus includes a flame simulation compartment 5 enclosed within three transparent walls (two side walls 6 and one front wall 7) and having a solid metal base 8. The transparent walls can be made of glass or another suitable material. In other embodiments the flame simulator may be enclosed within a differing number of transparent walls, or alternatively the walls may be metal plates or another suitable material. The electric heater assembly includes a heater air inlet 9 and a heater air outlet 10 on the front face of a heater housing assembly 11. An electric heater 12 (shown in FIG. 5) is located in the heater housing 11 which is above the flame simulation compartments. The heating apparatus shown in FIG. 1 is located within a cavity of a breast in a wall. Alternative embodiments without the glass side walls could be placed in a hole in a flat wall.

Various flame simulation techniques can be used in this Electric Fire which could be LCD (liquid crystal display), LED (light emitting diode), and ribbon blower arrangements etc. Alternatively, this new design of heater could also be used in other configurations of electric fires: wall hung, wall inset, suite, electric stoves and/or traditional inset fires.

Figure 3:
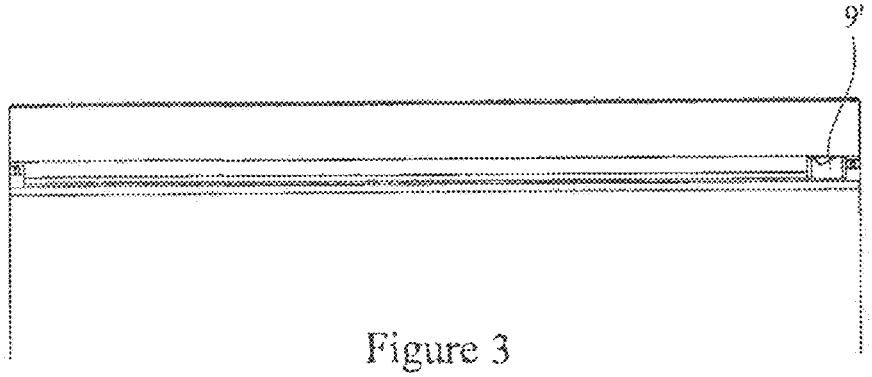
FIG. 3 is a front view of the top of the heating apparatus of FIG. 1 showing the air inlets and air outlet to the heater.
Figure 4:
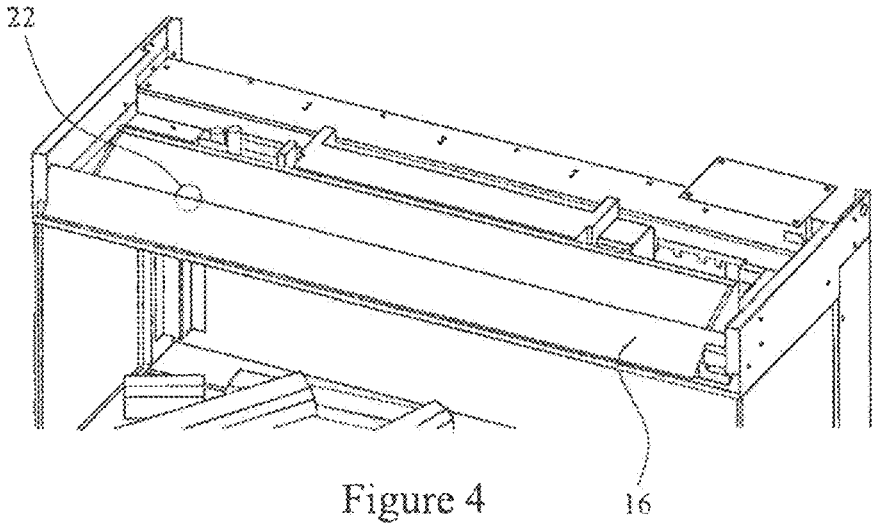
FIG. 4 is a top perspective view of the heating apparatus of FIG. 1 not installed in a wall or wall space and with the assembly top plate removed.

Referring to FIGS. 2 and 3, the heater assembly unit 11 includes air inlets 9, 9' and an air outlet 10 at its front end. An electric fan heater 12 is located towards the rear of the heater assembly. In use, air is drawn through the air inlets 9, 9', through the electric heater assembly and out through the air outlet in the direction shown by arrows in direction A, B and C. Arrow A shows the air flow through an air inlet channel 13; arrow B shows the air flow through the electric heater 12; and arrow C shows the air flow through an air outlet channel 14. Upper air inlet 9 is located above air outlet 10 and lateral air inlet 9' is located to the side of air outlet 10.

The air inlet channel is defined by the space between the top plate 15 of the heater assembly unit and an air outlet cover 16.

The air outlet passage of channel 14 is defined by the space between the air outlet passage cover 16 and a base plate 17 of the heater assembly 11 such that an air inlet passage would channel air drawn in by the fan to the heater and thence out through the air outlet passage and channel through the air outlet.

In alternative embodiments the heater assembly could be located to the side of or below the flame simulator.

The illustrated embodiment includes an upper air inlet 9 above the air outlet 10 and lateral air inlets 9' to the sides of the air outlet 10.

The upper air inlet 9 is a slot in the front of the heater assembly housing where the air can be drawn through. The lateral air inlets 9' are also slots.

The heater fan ensures that the air is moved through the system and through the heating element of the electric heater. In the described embodiment the fan is shown as part of the electric heater. The fan alternatively may be located at any point through the system. In the illustrated embodiment the fan is located adjacent the electric heater element. The electric heater element and fan are standard known components so will not be described in further detail. In an alternative embodiment the fan could also be an air pump or similar. The fan pushes/draws air through the heating element, which creates a current of air, as more air is pulled in to fill the vacuum of where the air was drawn from. This keeps drawing air through the housing cavity and into the heating element.

The heating element could be one of a number of known electrical heaters. A power output of 1.5 kW is suitable to heat a standard sized room. Any suitable heating element and fan system could be used.

Between the heating element and the housing outlet there is an outlet channel 14. This channel 14 allows the air to be expelled from the heating element and moved through the housing of the heating assembly system to be expelled into the room or area to be heated.

The outlet channel 14 between the heating element and the air outlet has a varying cross-section in the direction C of flow of air. The cross-section transitions from having a cross-section matching the outlet from the electric heater to an air outlet channel slot having a greater longitudinal or horizontal dimension and smaller vertical dimension. The "long and thin" outlet slot is less visible and therefore aesthetically more pleasing than the known grilles which are of a similar shape to the electric heater outlet. The "long and thin" outlet slot also allows the front glass wall 7 of the fireplace heater assembly to be located flush or close to the line of the wall 4 in which it is located, meaning that the air outlet does not need to have the same shape as the heating element outlet (not shown in figures). The outlet channel is defined by four walls or surfaces: an upper wall formed by the air outlet cover 16, a lower wall formed by the bare plate 17 of the heater unit, and two angled side walls 18. The upper and lower walls 16, 18 are configured to reduce the height of the air outlet channel 14 as air moves through it towards the outlet 10. As the channel moves from the heating element to the housing outlet the distance from the air outlet cover 16 to the base 17 is reduced gradually.

Figure 5:
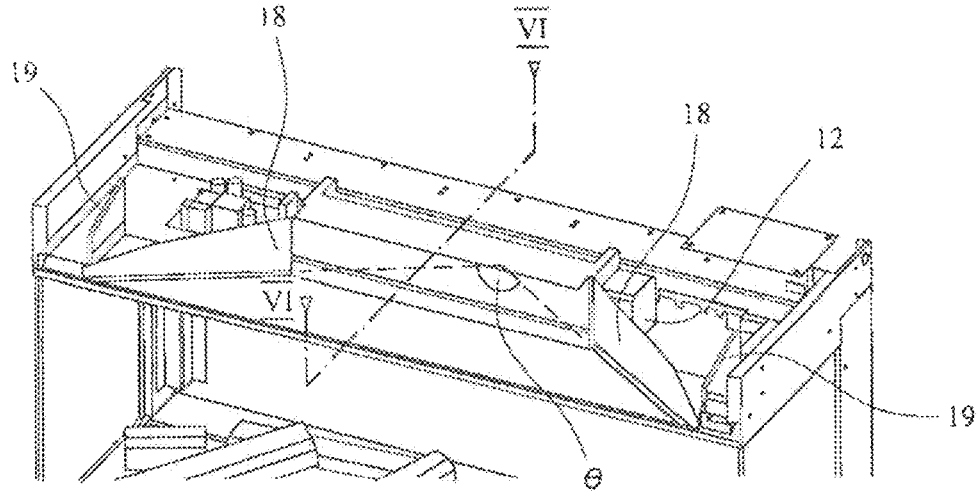
FIG. 5 is the top perspective view of FIG. 4 but with the heater and air outlet channel cover removed.
Figure 6:
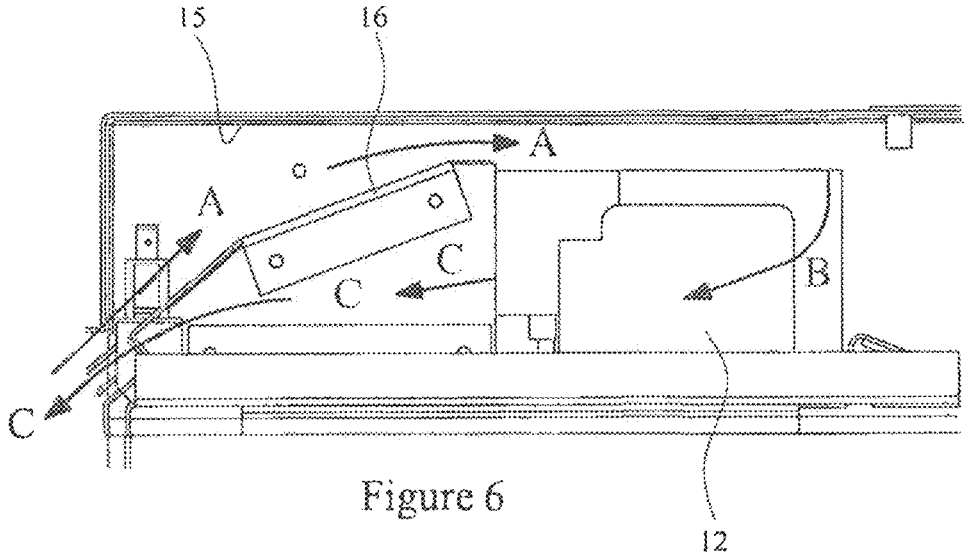
FIG. 6 is a view along the cross-section VI-VI of FIG. 5.

The cover 16 of the air outlet channel is formed by a cover sheet of metal. The cover 16 may be formed of one sheet of material, or may be formed of more than one sheet. The top wall may be wider than the outlet channel 14 as can be seen in FIGS. 5 and 6. In the illustrated embodiment the cover 16 extends across the whole width of the heater assembly housing 11. The cover 16 has a kink 22 in it (see FIG. 6). This kink 22 aids the gradual transition of hot air flowing in a horizontal direction when exiting the heating apparatus, to being angled downwards when flowing out of the outlet. The cover 16 is attached to the housing via brackets 19 to which it is screwed. Alternatively it may be welded to brackets or otherwise attached. Another alternative (not shown in figures) is that the sidewalls might have a lip to which the top wall may be screwed, welded or otherwise attached.

The channel in the illustrated embodiment of FIG. 5 has a height of 36 mm when immediately adjacent to the heating outlet. When the channel is adjacent to the housing outlet, it has a height of 9 mm. This height means that fingers cannot be trapped and is also low enough to make the outlet discreet to the onlooker.

The two outlet channel side walls 18 are configured to be sloped away from each other and spread apart with the distance between the two side walls 18 gradually increasing as the channel goes from the outlet of the electric heater 12 towards the housing outlet 10. The angle θ suspended between the side walls is 133°. Each side wall 18 may be formed of a singular sheet of material. The side walls 18 may be attached to the housing of the heater assembly 11. Alternatively the sidewalls 18 may be attached to the base plate 7 of the outlet channel. The side walls each have a lip (not shown) for attachment by screws, welding or equivalent means to the base plate 17.

Figure 7:
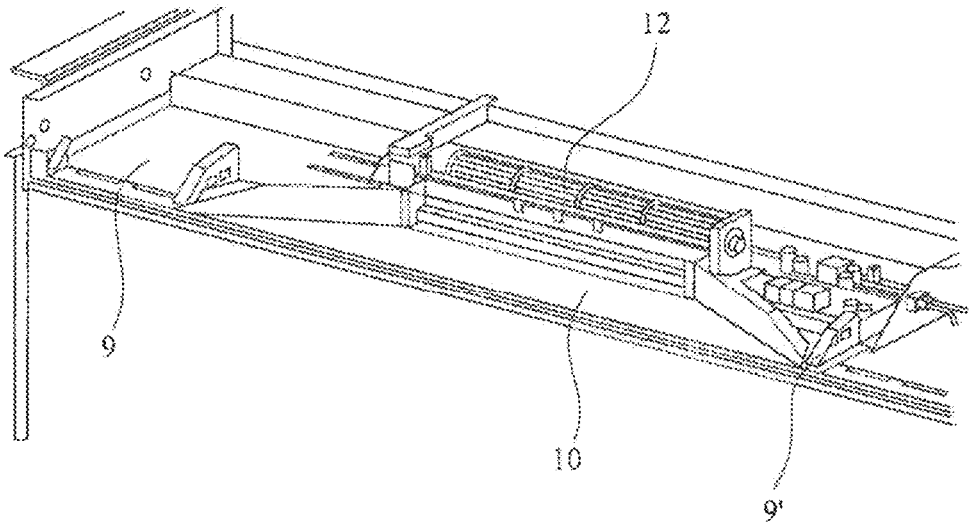
FIG. 7 is a top perspective view of an alternative embodiment of the invention (not installed in a wall or wall space, with its top plate and heater and air outlet cover removed).

The outlet channel side walls have lips to aid in attaching to the bottom wall. The outlet channel top wall is attached to the side walls via lips on the side walls (not shown) (shown in FIG. 7 but not FIG. 5). On the side of the top wall and bottom wall both are lips where the material has been bent perpendicular to the wall. The lips have screw holes to allow the heating outlet to be screwed to brackets of the housing. In this preferred embodiment the top wall also has lips on its front edge. These lips are also to screw the outlet to the housing.

The walls of the outlet channel may help form the inlet channel, as the air flows between the housing of the heating system and the outlet channel. Air is drawn into the housing The channel has a width of 326 mm when immediately adjacent to the heating element, and the channel may have a width of 693 mm when adjacent to the housing outlet.

The combined effect of this configuration is that the airflow goes from filling a first shape with a certain width and height as it leaves the heating element, to filling a second shape that has an increased width and a decreased height as is leaves the housing.

The invention claimed is:

1. A heating apparatus comprising:

a housing having a flame simulation compartment and a viewing window for viewing said compartment and flames simulated therein;

a flame simulator for simulating flames in said flame simulation compartment;

an electrical heater unit adjacent the flame simulation compartment, the heater unit including:

a heater, an air inlet, an air inlet channel connecting the air inlet to the heater, an air outlet, an air outlet channel connecting the heater to the air outlet, and a fan for drawing air into the air inlet, to then flow through the air inlet channel past the heater, through the air outlet channel and then through the air outlet, wherein the cross-sectional area of the air outlet channel in the planes perpendicular to the direction of the flow of air therethrough increases with increased distance from the heater, and wherein the air outlet channel transitions from having a cross section matching an outlet from the heater to an air outlet channel slot having a greater longitudinal or horizontal dimension and smaller vertical dimension;

wherein the air inlet channel extends along a top of the electrical heater unit, following a path from the air inlet to above and around the heater;

wherein the air outlet channel is configured to angle upward relative to the air outlet, such that heated air pushed from the heater is at a natural downward angle toward an area outward and beneath the electrical heater unit; and wherein the air inlet and air outlet are slots extending across a front face of the electrical heater unit, the air inlet slot aligned horizontally with the heater and being positioned directly above the air outlet slot.

2. The heating apparatus according to claim 1 wherein the air inlet channel and air outlet channel are adjacent each other but separated by a channel wall or walls.

3. The heating apparatus according to claim 1 where the air outlet channel includes two outlet channel side walls whose surface planes subtend an obtuse angle.

4. The heating apparatus according to claim 3 where the obtuse angle is between 120 degrees and 150 degrees.

5. The heating apparatus according to claim 4 where the obtuse angle is between 130 degrees and 135 degrees.

6. The heating apparatus according to claim 1, wherein the air inlet channel is arranged above the air outlet channel.

7. The heating apparatus according to claim 6 wherein the air inlet channel angles upward as it extends from the air inlet.

8. The heating apparatus according to claim 1 wherein, in use, the air inlet comprises multiple air inlets, one of the air inlets being located at the same height and alongside the air outlet.

9. The heating apparatus according to claim 1 wherein the air inlet and air outlet slots are defined to be substantially horizontal vents or slots in the front of the heating apparatus.

10. The heating apparatus according to claim 1 wherein the air outlet extends across more than 25% of the width of the front face of the electrical heater unit.

11. The heating apparatus according to claim 10 wherein the air outlet extends across more than 50% of the width of the front face of the electrical heater unit.

12. The heating apparatus according to claim 11 wherein the air outlet extends across more than 75% of the width of the front face of the electrical heater unit.

13. The heating apparatus according to claim 1 wherein the air outlet channel has a gradual reduction in vertical dimension from the electric heater outlet to the air outlet channel slot.

* * * * *